US005369819A

United States Patent [19]

Capuano, Jr.

[11] Patent Number: 5,369,819

[45] Date of Patent: Dec. 6, 1994

[54] TOILET SEAT RETAINING DEVICE

[76] Inventor: Earl Capuano, Jr., 3 Silverbrook Rd., Westport, Conn. 06880

[21] Appl. No.: 197,698

[22] Filed: Feb. 17, 1994

[51] Int. Cl.[5] ..... A47K 17/02

[52] U.S. Cl. ..... 4/661

[58] Field of Search ..... 4/234, 237, 253, 353, 4/661

[56] References Cited

U.S. PATENT DOCUMENTS

| | | | |
|---|---|---|---|
| 4,319,367 | 3/1982 | Cantillo | 4/353 |
| 5,052,061 | 10/1991 | Nichols | 4/661 |
| 5,240,212 | 8/1993 | Brodie | 4/661 X |

*Primary Examiner*—Robert M. Fetsuga
*Attorney, Agent, or Firm*—Edward R. Hyde

[57] ABSTRACT

A system for retaining a toilet seat and seat cover in a verticle position against a toilet water tank that comprises an elastic band that encircles the water tank. The seat and seat cover may be selectively held under the elastic band against the tank.

6 Claims, 1 Drawing Sheet

TOILET SEAT RETAINING DEVICE

BACKGROUND OF THE INVENTION

2. Field of the Invention

The present invention relates to a device for conveniently retaining a toilet seat in a vertical or upright position.

A situation that is regularly encountered is that of a toilet seat and seat cover that will not stay in the upright position when raised and leaning against the water tank. This is especially true of seat covers that are fabric covered because when the seat is upright the fabric cover is positioned between the seat assembly and the water tank and prevents adequate back tilting. The result is that the seat or the seat cover will fall forward down to the normal horizontal position. The present invention is directed to this general problem.

2. Description of the Prior Art

There exists a number of devices and patents directed to the problem of retaining the toilet seat and cover in the vertical position. Examples of such devices are found in U.S. Pat. Nos. 4,638,515, 4,763,362, 5,052,061 and 4,451,940. The devices shown in these patents attempt to resolve the problem of retaining the seat and seat cover vertically by means of hooks, magnetic devices, strap arrangements, etc. These prior art devices are generally structurally complex and inconvenient to operate in retaining the seat vertical and readily and conveniently releasing it. The present invention on the other hand provides a very simple and convenient device for solving the problem that these other prior more complex devices attempted to solve.

SUMMARY OF THE INVENTION

An elastic band is provided for the toilet seat and water tank that when in position encircles the water tank so that a toilet seat and seat cover may be raised and positioned under the elastic band. When it is desired to lower the seat, it is a simple matter of expanding the band and permitting the seat to lower to its horizontal position.

The elastic band is suitably covered by a fabric material preferably impervious to water so that the moisture from a sweating water tank will not be absorbed by the band device. Further, it is contemplated that attractive indicia be applied to the band cover.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein which.

DESCRIPTION OF THE PREFERRED EMBODIMENT

Figure 1:
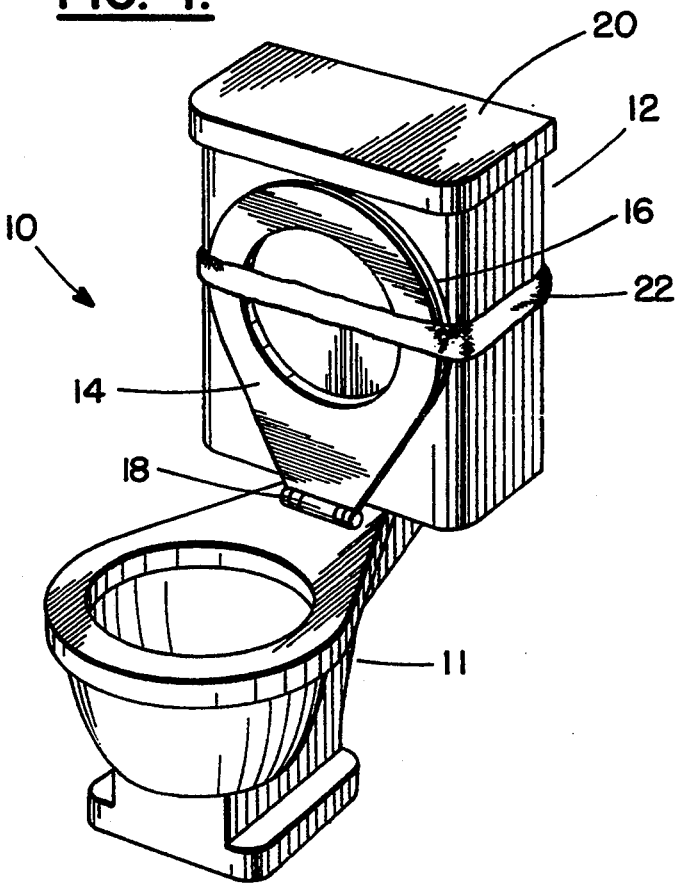
FIG. 1 is a perspective view of a toilet assembly with the band device of the present invention encircling the water tank and holding the toilet seat and cover in a vertical position.

Referring now to the drawings more particular FIG. 1 there is shown a conventional toilet assembly generally indicated by numeral 10 which includes a toilet 11 and water tank 12. The toilet is generally made of a porcelain material and has a seat 14 and seat cover 16 hinged to the top rear portion of the toilet as by a hinge member 18. The water tank has the customary valve mechanism inside and is covered by a top member 20.

As is well known the seat and seat cover have a normal horizontal position and a vertical position. As pointed out above, when the seat and seat cover are in their vertical position the problem exists that they often fall down to the horizontal position. The reason for this is that when they are vertical there is not sufficient room to tilt back against the water tank to maintain a stable vertical position. Hence, the seat 14 will fall forward unless it is retained by some device or mechanism. Similarly the seat cover 16 is likely to also fall forward.

Accordingly there is provided an elastic band 22 of sufficient size to fully encircle the water tank. The band has sufficient elasticity so that a person can expand it to position the seat 14 and seat cover 16 in back of the band and against the front of the water tank. The band may be located at any convenient vertical location around the tank as long as it is positioned to receive the seat or seat cover when they are hinged vertically upward as seen in FIG. 1.

Figure 2:
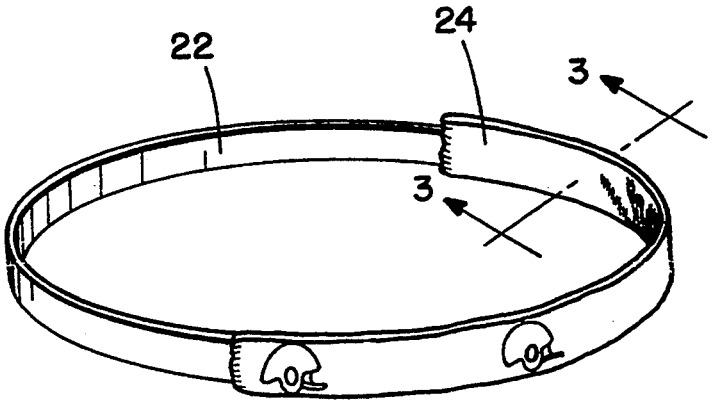
FIG. 2 is a perspective view of the band device.

Referring now to FIG. 2 there is shown an embodiment of the elastic band 22. In this embodiment the band 22 is of any convenient commercially available elastic fabric forming a circle in which the ends may be sewed together or otherwise secured to form a complete loop. A band cover 24 encircles a portion of the elastic band 22 and is preferably made of a water impervious material that will not absorb water droplets that sometimes form on water tanks. Thus both the elastic band 22 and band cover are washable for periodic cleaning and long term use. It is contemplated that the cover 24 carry indicia on the outer surface that could be advertising material or attractive designs in accordance with the decor of the bathroom. It is contemplated that the elastic band 22 also be made of a water impervious fiber in order to prevent water absorption.

Figure 3:
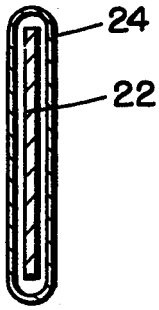
FIG. 3 is a sectional view taken on the line 3—3 of FIG. 2.

Although the band in the figures has been shown to be relatively narrow, it may take any convenient width and if more extension indicia is preferred the band may be considerably wider than shown in the drawings. The construction of the band in cross section is shown in FIG. 3 wherein the cover 24 is seen to encircle the elastic band 22.

Figure 4:
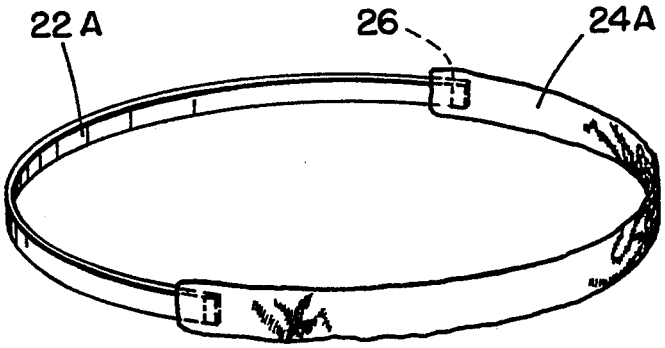
FIG. 4 is a view of a modification of the band of FIG. 2.

Referring now to FIG. 4, there is shown another embodiment of the elastic band. In this embodiment the elastic material *22a* does not form a complete loop but rather approximately half of a loop. The ends of the elastic band are secured to a non elastic material *24a* as by sewing at 26 or other securing means. In this embodiment the outer surface of strip *24a* would carry desired indicia. Both band *22a* and strip *24a* would also be formed of a water impervious fibers.

Having thus described the invention with particular reference to the preferred forms thereof, it will be obvious that various changes and modifications may be made therein without departing from the spirit and scope of the invention as defined in the appended claims.

What is claimed is:

1. A system for retaining a toilet seat in an upright position comprising:

a generally rectangular upright toilet water tank;

a hinged toilet seat and seat cover secured in place at the base of the said water tank;

elastic band means encircling the water tank and adapted to encircle the said seat and seat cover and maintain it in an upright position against the water tank;

said elastic band means comprising a flat elastic strip of fabric having two ends sewed together to form an enclosed loop;

a water impervious fabric cover encircling a portion of the enclosed loop elastic strip and indicia markings on the outside of the fabric cover to be visible at the front of the water tank with the elastic band means in place encircling said tank.

2. The system set forth in claim 1 in which the fabric cover is substantially non elastic.

3. The system set forth in claim 2 in which the fabric cover includes ends sewed to the elastic band means.

4. A system for selectively retaining a toilet seat and seat cover in an upright position comprising:

a toilet unit;

a vertical water tank secured to said toilet unit;

a seat and seat cover hinged to the rear of the toilet unit and adapted to be selectively positioned horizontally on the toilet unit and vertically against the water tank;

flat elastic band means encircling said water tank and adapted to encircle said seat and seat cover and maintain them in upright positions against the water tank;

said flat elastic band means being formed of a fabric material made of water impervious fabric; and a cover secured to the flat elastic band means,

5. The system set forth in claim 4 in which the elastic band means forms an enclosed loop,

6. The system set forth in claim 4 in which the elastic band means and cover each have two ends; and means to secure the elastic band means ends to the cover ends to form an enclosed loop,

* * * * *